US005483023A

United States Patent [19]

Barnes

[11] Patent Number: 5,483,023

[45] Date of Patent: Jan. 9, 1996

[54] HIGH VOLTAGE BUSHING FLANGE AND FLANGE TO INSULATOR JOINT

[75] Inventor: Gary R. Barnes, Delanson, N.Y.

[73] Assignee: General Electric Co., Schenectady, N.Y.

[21] Appl. No.: 215,836

[22] Filed: Mar. 22, 1994

[51] Int. Cl.[6] ..... H01B 17/26

[52] U.S. Cl. ..... 174/152 R

[58] Field of Search ..... 174/11 BH, 12 BH, 174/14 BH, 18, 137 R, 142, 152 R, 153 R, 167

[56] References Cited

U.S. PATENT DOCUMENTS

| | | | |
|---|---|---|---|
| 3,715,449 | 2/1973 | Cunningham et al. | 174/11 BH |
| 4,562,321 | 12/1985 | Bolongeat-Mobleu et al. | 200/148 A |
| 5,069,525 | 12/1991 | Seike et al. | 174/139 X |

FOREIGN PATENT DOCUMENTS

| | | | |
|---|---|---|---|
| 0524230 | 12/1978 | U.S.S.R. | 174/152 R |

*Primary Examiner*—Morris H. Nimmo
*Assistant Examiner*—Christopher Horgan
*Attorney, Agent, or Firm*—Nixon & Vanderhye

[57] ABSTRACT

A high voltage bushing includes an insulator sleeve adapted to be fitted over a conductor; an annular metal mounting flange telescoped over the sleeve, the mounting flange having a substantially smooth, axially extending cylindrical portion and a radial portion located at one end of the axial portion; an annular, axially extending epoxy layer between the mounting flange cylindrical portion and the insulator sleeve, the epoxy layer having a thickness of at least about 0.50 inch; and an annular ferrule sealing the juncture of the porcelain sleeve and the mounting flange on a side of the radial portion remote from the axial portion. The annular ferrule has a radial section engaging the radial portion of the mounting flange, and an axial section soldered to the porcelain sleeve.

16 Claims, 2 Drawing Sheets

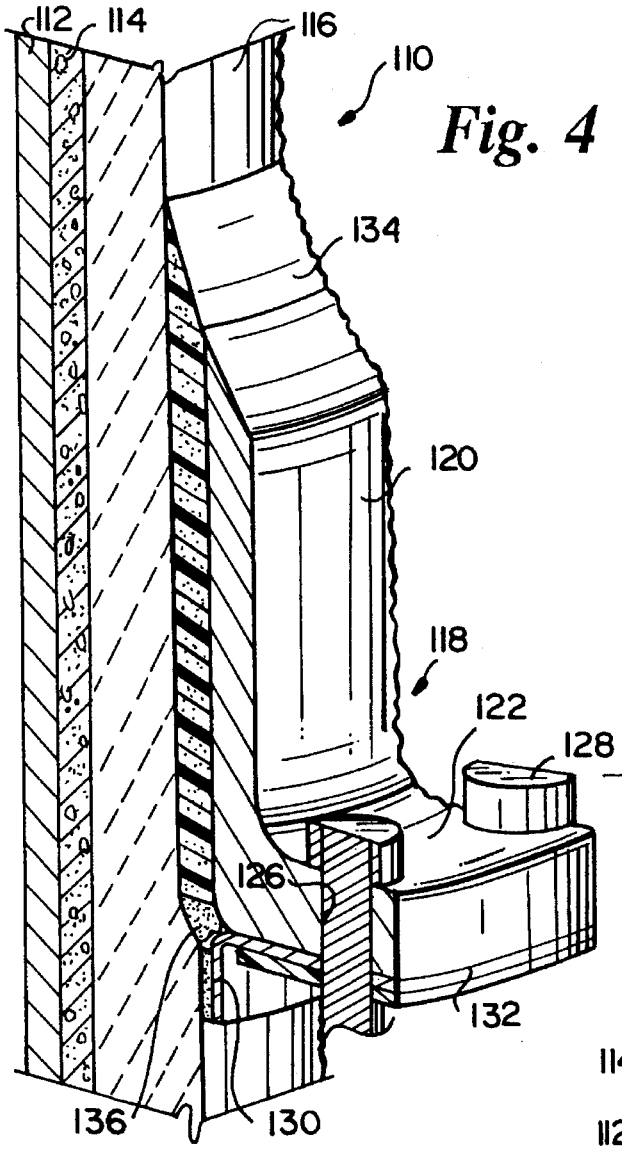
Fig. 4
Fig. 5A
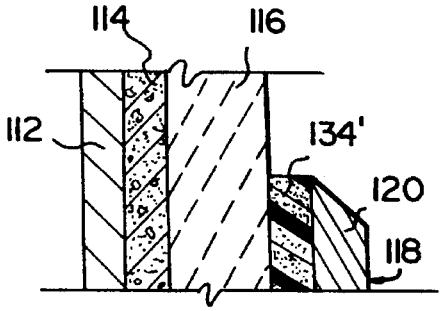
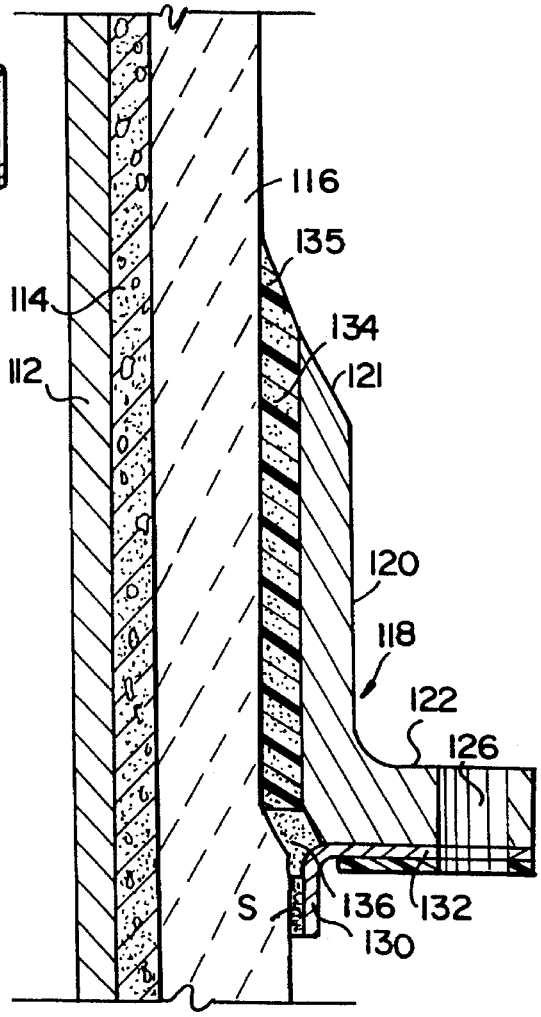
Fig. 5

HIGH VOLTAGE BUSHING FLANGE AND FLANGE TO INSULATOR JOINT

TECHNICAL FIELD

This invention relates generally to large generator constructions, and specifically, to a high voltage bushing utilized as a means of passing an electrical conductor through a pressure vessel wall.

BACKGROUND PRIOR ART

A high voltage bushing is conventionally used for passing an electrical conductor through a pressure vessel wall of, for example, a large generator, without allowing hydrogen gas inside the pressure vessel to leak out of the vessel. The conductor must be electrically insulated from the pressure vessel wall, and this is achieved by enclosing the conductor inside a porcelain sleeve or tube. An annular, sleeve-like metallic mounting flange is telescoped over the exterior surface of the porcelain sleeve and is utilized to attach the porcelain sleeve to the pressure vessel wall. One such high voltage bushing is illustrated in FIGS. 1–3. Bushings of this type, however, have been known to experience cracks during operation, the cause of which is presently not known with certainty. High voltage bushings used on large generators are rated for high currents and the conductor is directly cooled with gas or liquid. These high currents cause heat generation in the flange resulting in the flange having a higher temperature than the porcelain. The metallic flange also has a higher coefficient of thermal expansion than the porcelain insulator. It is thought that the combination of these two factors produce thermal stresses in the porcelain sleeve which are high enough to cause the porcelain to crack. Another possibility is that the high forces seen during a sudden short circuit can also generate stresses in the porcelain sleeve sufficient to cause cracks.

DISCLOSURE OF THE INVENTION

The objective of this invention is to reduce tensile stresses in the porcelain insulator sleeve under typical large generator operating conditions to a magnitude which is lower than the stress level which causes cracks. To achieve this end, the conventional mounting flange and porcelain insulator joint has been redesigned in a number of key respects. For example, previously employed reinforcing ribs or gussets extending axially in a direction of the conductor, and arranged circumferentially about the mounting flange between axial and radial portions of the flange, have been eliminated. These ribs created high eddy current losses which, in turn, generated high temperatures in the mounting flange. By eliminating the ribs, hoop stress in the porcelain sleeve is reduced.

In addition, the epoxy layer between the mounting flange and the porcelain sleeve has been increased in thickness. The epoxy is a soft material compared to the very stiff porcelain insulator sleeve and steel mounting flange. When the epoxy joint is thick enough, the high thermal expansion of the steel flange is decoupled from the low thermal expansion of the porcelain insulator. This decoupling reduces the tensile stress developed in the porcelain. This epoxy layer is now also terminated short of an annular shoulder in the sleeve defining different diameter portions of the sleeve. This eliminates the potential for axial expansion forces generated in the mounting flange transferring to the porcelain sleeve.

Another change relates to chamfering one or both of the epoxy material and adjacent flange edge at the axial free edge of the mounting flange, i.e., remote from the radial portion of the flange. This change reduces high bending stresses developed during sudden short circuits and the like.

Finally, a solder joint between a copper ferrule extending between the mounting flange and the porcelain insulator sleeve has been redimensioned. In addition, it has been recognized that the solder used to secure the ferrule to the sleeve must not be allowed to form a bridge between the porcelain sleeve and the mounting flange.

Accordingly, in its broader aspects, the invention relates to a high voltage bushing assembly comprising an insulator sleeve adapted to fit over a conductor, an annular metal flange mounted on the sleeve, the mounting flange consisting of an axial portion and a radial portion located at one end of the axial portion, the axial portion having a free end remote from the one end, the free end chamfered radially inwardly in a direction away from the radial portion; and an annular copper ferrule extending between said porcelain sleeve and an underside of said radial section.

In another aspect, the invention relates to a high voltage bushing comprising an insulator sleeve adapted to be fitted over a conductor, the sleeve having an annular shoulder between portions of the sleeve having different diameters; an annular metal mounting flange telescoped over the sleeve to a location adjacent said shoulder, the mounting flange having a substantially smooth, axially extending cylindrical portion and a radial portion located at one end of the axial portion; an annular, axially extending epoxy layer between the mounting flange cylindrical portion and the insulator sleeve, the epoxy layer terminating short of the annular shoulder.

In still another aspect, the invention relates to a high voltage bushing assembly comprising an insulator sleeve adapted to fit over a conductor, an annular metal flange mounted on the sleeve, the mounting flange consisting of an axial portion and a radial portion located at one end of the axial portion, the axial portion having a free end remote from the one end, the free end chamfered radially inwardly in a direction away from the radial portion; and an annular ferrule sealing the juncture of the porcelain sleeve and the mounting flange on a side of the radial portion remote from the axial portion, the annular ferrule having a radial section soldered to the radial portion of the mounting flange, and an axial section soldered to the porcelain sleeve but wherein no solder bridge is formed between the mounting flange and the insulator sleeve.

The above described redesign of the conventional high voltage bushing flange and flange insulator sleeve joint permits the bushing to carry higher currents by reducing stresses in the porcelain insulator sleeve and thus also reducing the risk of failure due to cracking. Other objects and advantages of the invention will become apparent from the detailed description which follows.

BRIEF DESCRIPTION OF THE DRAWINGS

FIG. 4 is a perspective view of the redesigned flange and flanged insulator joint in accordance with this invention;

FIG. 5 is a side elevation of the section illustrated in FIG. 4; and

FIG. 5A is a partial side section of an alternative bushing design in accordance with the invention.

BEST MODE FOR CARRYING OUT THE INVENTION

Figure 1:
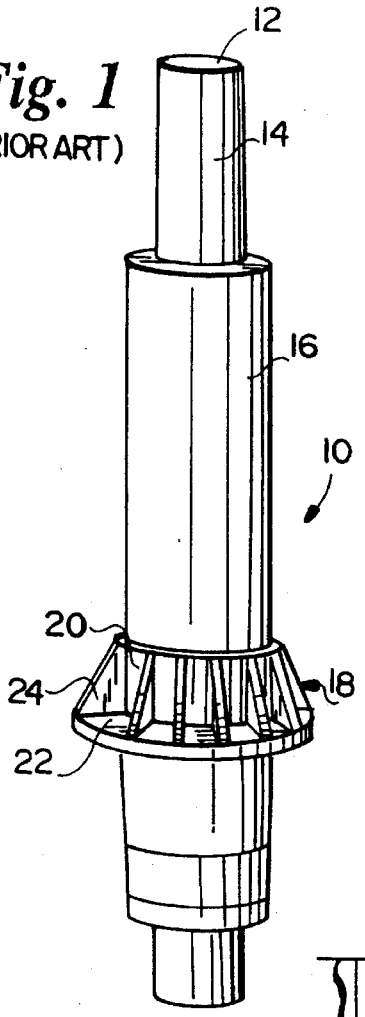
Fig. 1 (PRIOR ART)
FIG. 1 is a partial perspective view of a conventional water-cooled high voltage bushing.
Figure 2:
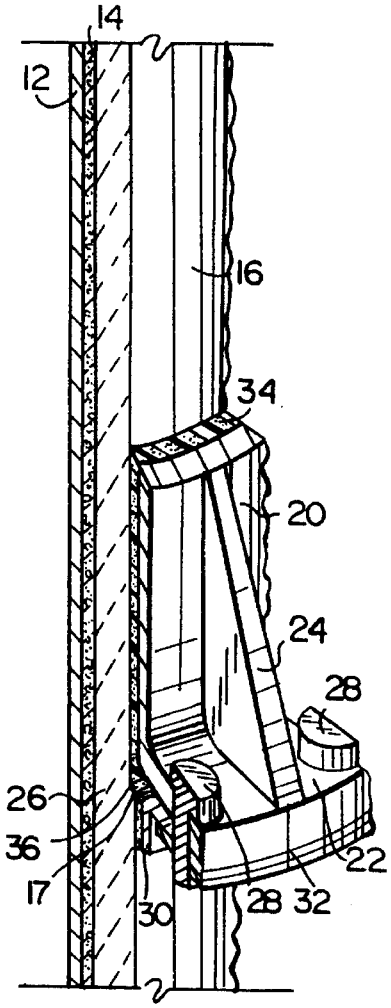
Fig. 2 (PRIOR ART)
FIG. 2 is a partial section removed from the conductor and bushing assembly illustrated in FIG. 1.
Figure 3:
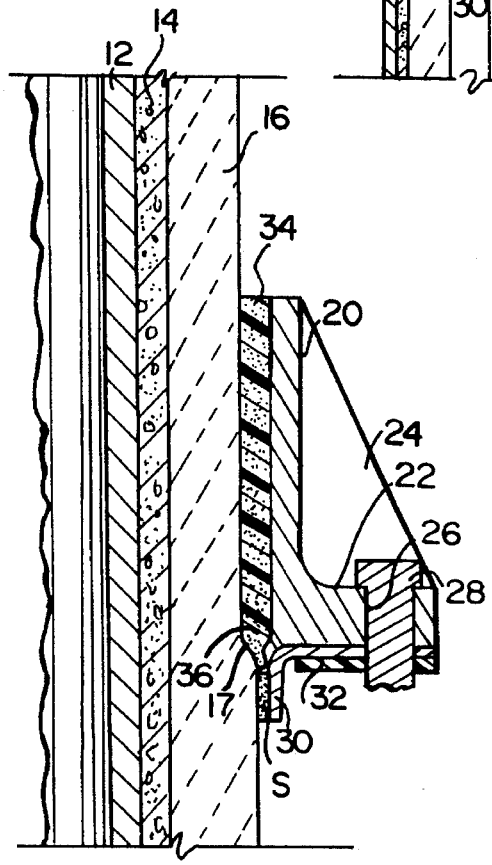
Fig. 3 (PRIOR ART)
FIG. 3 is a side elevation of the section illustrated in FIG. 2.

With reference to FIGS. 1–3, a conventional water cooled high voltage bushing 10 is shown enclosing a copper conductor 12. The bushing includes a porcelain insulator sleeve or tube 16 which increases in diameter at a shoulder 17. A wrap 14 of asphalt or similar material may be positioned between the conductor 12 and porcelain insulator sleeve 16. A metal mounting flange 18 is telescoped over the porcelain insulator sleeve 16 to a location adjacent the shoulder 17, and is utilized to secure the insulator sleeve 16 to a pressure vessel wall (not shown). The mounting flange 18 includes an axial portion 20 and a radial flange portion 22, with a plurality of angled reinforcing ribs or gussets 24 extending between the axial portion 20 and the adjacent surface of the radial portion 22, at equally circumferentially spaced locations about the mounting flange 18. The radial flange portion 22 is also provided with a plurality of axially oriented through holes 26 (FIGS. 2 and 3) which enable the bushing to be secured to the pressure vessel wall by means of, for example, bolts 28.

An annular copper ferrule 30 is also telescoped over the insulator sleeve 16, and is located so as to engage the radial portion of the mounting flange in "back-to-back" relationship as best seen in FIG. 3. The ferrule is soldered (solder indicated by S in FIG. 3) to the insulator sleeve and a gasket 32 is secured on the exposed side of the ferrule radial portion for engagement with the pressure vessel wall.

The mounting flange 18 is secured to the porcelain insulator sleeve 16 by means of an epoxy layer 34, having a thickness of about 0.406 in., between the axial section 20 of the flange and the insulator sleeve 16. An annular space between the epoxy layer 34 and the ferrule 30 may be filled with caulk, as indicated by reference numeral 36.

Turning now to FIGS. 4 and 5, an improved high voltage bushing in accordance with this invention is illustrated. For convenience, similar reference numerals (but with the prefix "1" added) are used to designate corresponding components where possible. Thus, the bushing 110 is shown enclosing a copper conductor 112 having a wrap 114 of asphalt or similar material therebetween, and includes a porcelain insulator sleeve 116 and a metal mounting flange 118. The latter is telescoped over the porcelain sleeve 116 to a location adjacent the shoulder 117 and is utilized to attach the porcelain sleeve 116 to the pressure vessel wall (again, not shown). The mounting flange 118 includes an axial portion 120 and a radial flange portion 122 at one end of the axial portion 120. The plurality of angled reinforcing ribs or gussets 24 extending between the axial and radial portions of the mounting flange as utilized in the conventional bushing 10 have been eliminated. The radial flange portion 122 is also provided with a plurality of axially oriented through holes 126 which enable the bushing 110 to be secured to the pressure vessel wall by means of bolts 128 or other suitable fasteners.

An annular copper ferrule 130 is telescoped onto the sleeve 116 to a location where it abuts the radial portion 122 of the mounting flange 118. The ferrule 130 serves as a seal, preventing escape of hydrogen from inside the pressure vessel where the mounting flange 118 is joined to the pressure vessel wall. A gasket 132 extends over the exposed side of the ferrule radial portion and is adapted to be compressed between the ferrule 130 and the pressure vessel wall. The gasket 132 may be an o-ring positioned in a mating recess in the pressure vessel wall so that it is compressed between the ferrule 130 and the pressure vessel wall.

The bushing 110 is secured to the copper conductor 112 by means of an epoxy joint 134 between the axial section 120 of the mounting flange 118 and the insulator sleeve 116.

While there are a number of similarities between bushings 10 and 110, there are significant differences. In the bushing 110 in accordance with this invention:

1. The reinforcing ribs or gussets 24 have been eliminated.
2. The thickness of the epoxy joint 134 has been increased from 0.406 in. in the conventional construction to substantially 0.50 inch.
3. At least the axial edge 121 of the axial portion 120 of the mounting flange 118 (and, if desired, the adjacent free edge 135 of the epoxy layer 134 as shown in FIG. 4) has been chamfered at the air end (i.e., the end away from the pressure vessel) of the mounting flange 118. Preferably, only the free edge 121 of the axial portion 120 of the sleeve 116 is chamfered, as shown in FIG. 5A.
4. The solder joint S between the ferrule 130 and sleeve 116 has been reduced in thickness from about 0.22 in. to 0.12 in., and axially shortened from about 1.0 inch to about 0.75 inch.
5. No solder S is permitted to bridge the gap between the porcelain insulator sleeve 116 and the radial flange portion 122 of the mounting flange 118. This may be achieved by creating a temporary dam in the space 136 during the soldering of the ferrule. Previously, there were no positive steps taken to avoid the creation of such a bridge. Caulking is still applied in the space 136 but only after confirmation that no solder bridge has been formed. The caulk is comprised of a material that does not transmit stress, such as nylon rope or fiberglass rope.
6. The axial extent of the epoxy layer is shortened so that the epoxy does not engage the shoulder 117.

These changes, and the positive results produced by these changes are discussed further below.

Tensile stresses in the porcelain insulator sleeve 116 have been reduced, particularly via elimination of the mounting flange stiffening webs or gussets 24, and by increasing the thickness of the epoxy layer 134. The high eddy current losses created by the stiffening ribs 24 generated high flange temperatures relative to the porcelain temperatures. Removing the ribs thus produces a significant reduction in the porcelain hoop stress.

The stiffness of the epoxy layer 134 used to bond the mounting flange 118 to the porcelain insulator sleeve 116 is quite low compared to the stiffness of porcelain and the stainless steel, especially at operating temperatures. This allows the increased thickness epoxy layer or joint 134 deform easily to accommodate the differential thermal expansion of the flange 118 and porcelain insulator sleeve 116. In other words, the epoxy joint is able to isolate the high radial expansion of the mounting flange 118 from the low radial expansion of the porcelain.

The one change which was included to reduce sudden short circuit stresses was the chamfer at the air end of the mounting flange 118. These chamfers in one or both of the epoxy layer 134 and the flange edge 121 remove stress concentrations at the free end of the flange 118.

The radial thickness and the axial length of the solder joint between the ferrule 130 and sleeve 116 were both decreased on the redesigned bushing. The solder S and the copper ferrule 130 both expand more than the porcelain sleeve 116. This situation creates a compressive hoop stress in the solder S and ferrule 130 and a tensile hoop stress in the porcelain insulator sleeve 116. The tensile hoop stresses in the porcelain sleeve 116 are reduced as the solder radial thickness is reduced and as the axial length of the solder joint is reduced. Both reductions make the overall stiffness of the solder/ferrule structure smaller. The reduced stiffness of the solder/ferrule reduces the radial displacement of the porcelain surface due to thermal expansion which reduces the resulting porcelain sleeve stress.

The most important change to the solder joint between the ferrule 130 and the sleeve 116 is the requirement to block solder flow from the porcelain sleeve 116 to the mounting flange 118 during the manufacturing process. A rigid solder bridge otherwise couples the greater radial thermal expansion of the flange 118 directly to the porcelain sleeve 116 and can produce very high tensile stresses in the porcelain sleeve. By taking steps during the manufacturing process to prevent bridge formation, a potential cause of cracks in the sleeve 116 is eliminated.

The increase in diameter of the porcelain sleeve at 117, adjacent the flange 118, provides a problem area. If the epoxy joint is extended into this region (as shown in FIG. 3), a load path is created which transfers the axial expansion forces generated in the flange 118 into the porcelain sleeve 116. These forces produce high tensile bending stresses at the stress concentration formed by the concave corner of the porcelain. Therefore, the epoxy joint or layer 134 terminates axially before the porcelain diameter increases at 117.

In summary, the above described redesign of the conventional high voltage bushing has significantly reduced the potential for cracks in the porcelain sleeve during large generator operation.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A high voltage bushing assembly comprising:

an insulator sleeve adapted to fit over a conductor, an annular metal flange mounted on said sleeve, said mounting flange consisting of an axial portion and a radial portion located at one end of said axial portion, said axial portion joined to said sleeve by an adhesive layer, the composition and thickness of which is sufficient to decouple the relatively high thermal expansion of the sleeve from the relatively low thermal expansion of the mounting flange, said axial portion having a free end remote from said one end, said free end chamfered radially inwardly in a direction away from said radial portion; and an annular copper ferrule extending between said insulator sleeve and an underside of said radial portion.

2. The bushing of claim 1 wherein said insulator sleeve is porcelain.

3. The bushing of claim 1 wherein said adhesive layer is chamfered at said free end to form a substantially unbroken surface with said free end of said axial portion.

4. The bushing of claim 1 wherein said ferrule is soldered to said sleeve in back-to-back relationship with said mounting flange such that no solder contacts said mounting flange.

5. The bushing of claim 4 wherein solder between said ferrule and said insulator sleeve is about 0.12 inches thick.

6. The bushing of claim 1 wherein said adhesive layer comprises an epoxy layer about 0.5 in. thick.

7. The bushing of claim 1 wherein a solder joint between said ferrule and said insulator sleeve has an axial length of about 0.75 inch.

8. The bushing of claim 1 wherein said mounting flange has a length of about 6 in.

9. The bushing of claim 1 wherein solder between said ferrule and said sleeve is about 0.12 inches thick and wherein said epoxy joint is about 0.5 inches thick.

10. A high voltage bushing comprising:

an insulator sleeve adapted to be fitted over a conductor, said sleeve having an annular shoulder between portions of the sleeve having different diameters;

an annular metal mounting flange telescoped over said sleeve to a location adjacent said shoulder, said mounting flange having a substantially smooth, axially extending cylindrical portion free of any reinforcement gussets, and a radial portion located at one end of the axial portion;

an annular, axially extending epoxy layer between said mounting flange cylindrical portion and said insulator sleeve, said epoxy layer, the composition and thickness of which is sufficient to decouple the relatively high thermal expansion of the sleeve from the relatively low thermal expansion of the mounting flange, said axial portion terminating short of said annular shoulder.

11. The high voltage bushing of claim 10 and further comprising an annular ferrule sealing the juncture of said insulator sleeve and said mounting flange on a side of said radial portion remote from said axial portion, said annular ferrule having a radial section soldered to said radial portion of said mounting flange, and an axial section soldered to said insulator sleeve but wherein no solder bridge is formed between said mounting flange and said insulator sleeve.

12. The bushing of claim 11 wherein said insulator sleeve is porcelain.

13. The bushing of claim 11 wherein an annular space created between said epoxy layer, said mounting flange and said annular ferrule is filled with caulk.

14. The bushing of claim 11 wherein solder between said ferrule and said sleeve is about 0.12 inches thick.

15. The bushing of claim 11 wherein a solder joint between said ferrule and said insulator sleeve has an axial length of about 0.75 inch.

16. The bushing of claim 11 wherein said mounting flange has a length of about 6 in.

* * * * *